US009502787B2

(12) United States Patent
Schnoor

(10) Patent No.: US 9,502,787 B2
(45) Date of Patent: Nov. 22, 2016

(54) METALLIC PRIMARY-STRUCTURE ELEMENT FOR POTENTIAL EQUALIZATION IN AN AIRCRAFT

(71) Applicant: Airbus Operations GmbH, Hamburg (DE)

(72) Inventor: Martin Schnoor, Hamburg (DE)

(73) Assignee: AIRBUS OPERATIONS GMBH, Hamburg (DE)

( * ) Notice: Subject to any disclaimer, the term of this patent is extended or adjusted under 35 U.S.C. 154(b) by 0 days.

(21) Appl. No.: 14/754,988

(22) Filed: Jun. 30, 2015

(65) Prior Publication Data

US 2016/0006140 A1 Jan. 7, 2016

(30) Foreign Application Priority Data

Jul. 2, 2014 (DE) ..... 10 2014 109 282

(51) Int. Cl.

| | |
|---|---|
| ***H01R 13/648*** | (2006.01) |
| ***H01R 4/66*** | (2006.01) |
| ***H01R 4/30*** | (2006.01) |
| ***H01R 4/02*** | (2006.01) |
| ***H01R 43/02*** | (2006.01) |
| ***H01R 4/64*** | (2006.01) |

(52) U.S. Cl.

CPC ..... *H01R 4/30* (2013.01); *H01R 4/029* (2013.01); *H01R 4/646* (2013.01); *H01R 43/02* (2013.01); *H01R 2201/26* (2013.01)

(58) Field of Classification Search

CPC ..... H01R 4/30; H01R 4/029; H01R 4/646; H01R 4/02; H01R 43/02; H01R 2201/26

USPC ..... 439/801, 108, 62, 95, 97; 29/874

See application file for complete search history.

(56) References Cited

U.S. PATENT DOCUMENTS

| | | | | |
|---|---|---|---|---|
| 5,418,330 A * | 5/1995 | Rook | ..... | H01R 9/0512 174/75 C |
| 5,468,911 A | 11/1995 | Leve et al. | | |
| 7,677,906 B2 | 3/2010 | Luttermann et al. | | |

FOREIGN PATENT DOCUMENTS

| | | |
|---|---|---|
| DE | 4226904 A1 | 2/1994 |
| DE | 202008002149 U1 | 4/2008 |

* cited by examiner

*Primary Examiner* — Javaid Nasri

(74) *Attorney, Agent, or Firm* — Lorenz & Kopf LLP

(57) ABSTRACT

This relates to a metallic primary-structure element for an aircraft with a recess, a ground connection that is attached in the recess, and connected in an electrically conductive manner to the metallic primary-structure element, and is designed to receive a connector. This further relates to a method for potential equalization in an aircraft, wherein potential equalization between electrical or electronic devices on board the aircraft and the aircraft itself is produced.

10 Claims, 2 Drawing Sheets

METALLIC PRIMARY-STRUCTURE ELEMENT FOR POTENTIAL EQUALIZATION IN AN AIRCRAFT

CROSS-REFERENCE TO RELATED APPLICATIONS

This application claims priority to German Patent Application No. 10 2014 109 282.1, filed Jul. 2, 2014, which is incorporated herein by reference in its entirety.

TECHNICAL FIELD

The embodiments described herein relate to aviation and space related applications. In particular, the embodiments relate to a metallic primary-structure element for potential equalization between the primary structure of the aircraft and electrical and electronic devices situated on board the aircraft. Furthermore, the embodiments relate to a method for bringing about potential equalization in an aircraft.

BACKGROUND

In operation, electrical devices and their housing components can become electrically charged due to the lack of an electrical connection to their surroundings. Such electrical charging presents a potential risk of injury to persons who come into contact with these devices. In order to prevent electrical charging of the electrical devices and of the electrically conductive housing components with high electrical voltages, ground connections are frequently provided by way of which a connection between the electrical devices and the surroundings is established so that voltage equalization can take place. To this effect, as a rule, electrical conductors, e.g. cable lines, whose one end is connected to the electrical devices and whose other end comprises cable terminals, are screwed to a potential equalization element by way of the cable terminals. Thus, by way of the screw connection an electrically conductive connection between the electrical device and the potential equalization element is established. Producing the electrically conductive connection is often time consuming.

Other objects, desirable features and characteristics will become apparent from the subsequent summary and detailed description, and the appended claims, taken in conjunction with the accompanying drawings and this background.

SUMMARY

According to an embodiment, a metallic primary-structure element for an aircraft with a recess and a ground connection is provided. The ground connection is attached in the recess, is connected in an electrically conductive manner to the primary-structure element, and is designed to receive a connector.

The metallic primary-structure element is, for example, a primary-structure element of an aircraft, for example a frame element, a stringer or a floor panel. These components are, for example, made from metallic and electrically conductive materials and are connected among themselves and are electro-conductively connected to further components of the aircraft fuselage, e.g. to the aircraft's exterior skin.

Primary-structure elements of an aircraft may be made from an aluminum alloy. The primary structure can therefore be used as a potential equalization element for electrical devices located on board the aircraft. A metallic primary-structure element can also be provided in the form of a thin and/or cuboid plate on the frame elements, stringers and/or other metallic structural elements. In this design, the plate-shaped primary-structure element can, for example, be welded or screwed into place in the interior of the aircraft fuselage. In any case the metallic primary-structure element can be electro-conductively connected to other aircraft components or can be integrated in other aircraft components.

The metallic primary-structure element can comprise a recess. This recess can be a blind hole or a through-hole of any shape, in which blind hole or through-hole the ground connection has been embedded. In this embodiment the ground connection can also be of any shape so that it can be affixed in the recess having positive fit or having non-positive fit. In one example, the ground connection can comprise at least in part a circular cross section so that, if the recess is also circular in shape, the ground connection can be affixed in the recess with a non-positive fit or with a positive fit. For example, the ground connection is connected to the metallic primary-structure element by way of a press connection. However, it is also possible for the ground connection to be screwed into the metallic primary-structure element. To this effect, in one example, an external thread can be provided on the ground connection, and on the metallic primary-structure element, an internal thread can be provided in the blind hole or through-hole.

The ground connection can be made from metal and is also electrically conductive. If the ground connection is attached in the primary-structure element, both components are in direct contact with each other so that an electrically conductive connection is established between the ground connection and the metallic primary-structure element and thus also between the ground connection and other components in the aircraft, which components are connected to the metallic primary-structure element, e.g. the primary structure of the aircraft. However, it is also possible to provide a further electrically conductive component between the ground connection and the metallic primary-structure element, by way of which electrically conductive component, the electrically conductive connection is established.

The ground connection can comprise an elongated shape, for example, that of a pin or of a screw. In this design, a first end of the ground connection can be connected, either directly or by way of a further component, to the metallic primary-structure element, wherein the second end of the ground connection comprises a plug connection for receiving the connector.

According to an embodiment, the recess of the metallic primary-structure element is a borehole.

The borehole can be a through-bore through a primary-structure element, that is, for example, plate-shaped or bowl-shaped. The ground connection is preferably attached in the borehole by means of a press connection. However, the borehole can, for example, also comprise an internal thread for a screw connection so that the ground connection can be screwed into this borehole.

According to an embodiment, the ground connection comprises a cylindrical component.

The ground connection can, for example, comprise an elongated shape, wherein the cross-sectional shape and/or the cross-sectional area can vary along the longitudinal axis of the ground connection. In this embodiment, part of the ground connection can be cylindrical. For example, the first end the ground connection is cylindrical in order to engage the recess, which, for example, is also cylindrical. In contrast to this, the second end of the ground connection can comprise a connection option for a connector. The ground connection can, however, also comprise several cylindrical components, wherein the cross-sectional areas of the cylindrical components differ.

According to a still further embodiment the ground connection comprises at least one protuberance that projects perpendicularly to the longitudinal axis of the cylindrical component of the ground connection, from the generated surface, i. e. outer surface, of the cylindrical component.

It is also possible for several protuberances to project from the generated surface of the cylindrical component. Preferably, two protuberances are provided on the generated surface of the cylindrical component, which protuberances, relative to the cylindrical component, project in the radial direction from the generated surface of the cylindrical component. In this design the protuberances are arranged on the generated surface so as to be offset, e.g. in the circumferential direction of the cylindrical component, in each case by 180 degrees, in other words opposite each other. The protuberances can also be cylindrical.

A connector that is plugged onto the cylindrical component of the ground connection comprises, for example, holes or elongated holes that the protuberances of the cylindrical component engage when the connector is in its plugged-in state. The plugged-in state is characterized in that an electrically conductive connection is established between the ground connection and the connector. The connector can, in turn, be connected to electrical and/or electronic devices by way of a cable line or a cable harness so that when the connector is in its plugged-in state, an electrically conductive connection between the electrical or electronic devices, which are, for example, on board the aircraft, and the metallic primary structure of the aircraft is established. To this effect the connector comprises, for example, a metallic element that is electrically conductive and in its plugged-in state is in contact with the cylindrical component of the ground connection. Furthermore, on the connector, at least in part, an electrically insulating sheath can be provided. Thus the risk of injury to operating personnel as a result of an electric shock when plugging the connector into the ground connection can be reduced.

The connector can, furthermore, comprise a second recess, into which the cylindrical component of the ground connection projects when the connector is in its plugged-in or plugged-on state. The second recess can, for example, be a blind hole that is also cylindrical. In the second recess of the connector, holes or elongated holes can be provided that the protuberances of the cylindrical component of the ground connection engage when the connector is in its plugged-in or plugged-on state. In this embodiment, the second recess of the connector can be designed in such a manner that it is rotated onto the cylindrical component of the ground connection. The connector can thus comprise a rotation lock. The rotation lock can be a screw connection or preferably a click-lock mechanism.

Correspondingly, the connector is designed to be plugged onto the cylindrical component and to click into place in the ground connection in the manner of a click-lock mechanism. To this effect, on the connector a hole an elongated hole in the radial direction relative to the cylindrical component of the ground connection can be provided on the connector a hole, with the protuberance engaging or projecting into the hole or elongated hole when the connector has been plugged on. Consequently the connector cannot be unplugged when the protuberances project into the hole or into the elongated hole of the connector.

According to yet a further embodiment, the ground connection comprises a sleeve that is electro-conductively connected to the metallic primary-structure element.

The sleeve can, for example, be firmly connected to the ground connection by way of a positive-locking connection; as an alternative the sleeve and the ground connection are integrally manufactured in one component. The sleeve can be made from metal; it establishes an electrically conductive connection between the cylindrical component of the ground connection and the metallic primary-structure element of the aircraft.

According to still a further embodiment the sleeve is rotationally symmetrical and comprises at least one supporting surface that is connected to the metallic primary-structure element.

The rotation axis of the sleeve may be parallel or congruent to the rotation axis of the cylindrical component of the ground connection. The sleeve can comprise a supporting surface that is arranged so as to be perpendicular to the longitudinal axis of the cylindrical component of the ground connection and/or to project in the radial direction from the generated surface of the cylindrical component of the ground connection. In this embodiment the supporting surface of the sleeve can be in contact with the metallic primary-structure element. Furthermore, the sleeve can be cylindrical so that the ground connection can be attached, by way of the sleeve, in the cylindrical recess or borehole of the metallic primary-structure element.

According to yet another embodiment, the connection between the rotationally symmetrical sleeve and the metallic primary-structure element is selected from the group comprising a press connection, a weld connection or a screw connection.

In any case the connection between the sleeve and the metallic primary-structure element is designed so as to be electrically conductive.

According to another embodiment, the connection between the rotationally symmetrical sleeve and the cylindrical component of the ground connection is selected from the group comprising a press connection, a weld connection or a screw connection.

In any case the connection between the sleeve and the cylindrical component of the metallic primary-structure element is designed so as to be electrically conductive. The ground connection with the rotationally symmetrical sleeve and the cylindrical component is preferably made from one component. This means that the ground connection that comprises the rotationally symmetrical sleeve and the cylindrical component is integrally manufactured, for example by means of turning and/or milling. The ground connection can also be a standardized component.

According to a further embodiment, furthermore, a metallic aircraft primary structure comprising a multitude of metallic primary-structure elements is provided.

The metallic primary-structure elements can, for example, be connected to various structural components of the aircraft, in other words to the aircraft primary structure such as frame elements, stringers, floor panels, etc. In this embodiment the metallic primary-structure elements can be welded to or screwed to the aircraft primary structure. Furthermore, the metallic primary-structure elements can be integrated in the aircraft primary structure.

It should be noted that the presently described device of a ground connection is not limited to aircraft, but can, in particular, be used in mobile devices or vehicles.

According to a further embodiment, a method for potential equalization in an aircraft is stated. In one step of the method, a metallic primary-structure element for an aircraft is provided. In a further step of the method a ground connection is affixed to a recess of the metallic primary-structure element. In a still further step of the method, an electrically conductive connection between the metallic primary-structure element and the ground connection is established. In yet a further step of the method, a connector is received by the ground connection.

Further steps in the method can be provided that relate, for example, to the production and assembly of the metallic primary-structure element, of the ground connection, and of the connector. Such method-related steps are explained in more detail, as examples, in the following description of the figures.

By means of the ground connection that can be inserted into the metallic primary-structure element, and by means of plugging the connector onto the ground connection, potential equalization, as occurs, for example, during grounding on earth-bound applications, between electrical and/or electronic devices and the primary structure of the aircraft can take place. Potential equalization by means of this arrangement can be used wherever cable harnesses or grounding cables, i.e. electrical power lines, ground returns and/or ground couplings, are present. The cable harnesses can be present in the form of cable bundles. The cable bundles can be firmly connected to the connector, thus providing an electrically conductive connection between on-board devices of the aircraft and the primary structure of the aircraft. In one embodiment, cable lines can be connected to the connector.

In this manner screwing cable terminals to the aircraft primary structure may be not be necessary for potential equalization. In other words, the use of grounding straps with rivets, nuts or screws for fastening the cable lines to the primary structure of the aircraft can be avoided. Correct fastening no longer needs to be ensured by the provision of blue varnish. There is thus no longer any requirement to check the ground junction and the blue-varnish securing device. Furthermore, there is no longer any need to bare the metal for screwing cable terminals into place because the ground connection can be firmly integrated in the metallic primary structure of the aircraft. Generally speaking, an increase in the quality of the ground junctions and simple system installation, as well as separation of responsibilities can be achieved with the described ground connection. Moreover, many mechanical steps are no longer required, for example chamfering, screwing into place, checking/testing, applying varnish, reworking etc., and troubleshooting can be simplified. Tests, for example the GTR (ground test requirement) and the GTI (ground test instruction) are no longer needed, and, furthermore, the reproducibility of tests can be ensured. The assembly time and the number of components used, for example screws and nuts, can be reduced with the described ground connection. Consequently, in turn, space and weight can be saved, which is advantageous in particular in the application in aircraft. The assembly time can be significantly reduced because the connector now only needs to be plugged onto the ground connection, instead of the cable lines or cable terminals having to be screwed individually on the primary structure of the aircraft.

BRIEF DESCRIPTION OF THE DRAWINGS

The various embodiments will hereinafter be described in conjunction with the following drawing figures, wherein like numerals denote like elements, and.

DETAILED DESCRIPTION

The following detailed description is merely exemplary in nature and is not intended to limit the disclosed embodiments or the application and uses thereof. Furthermore, there is no intention to be bound by any theory presented in the preceding background detailed description.

Figure 1:
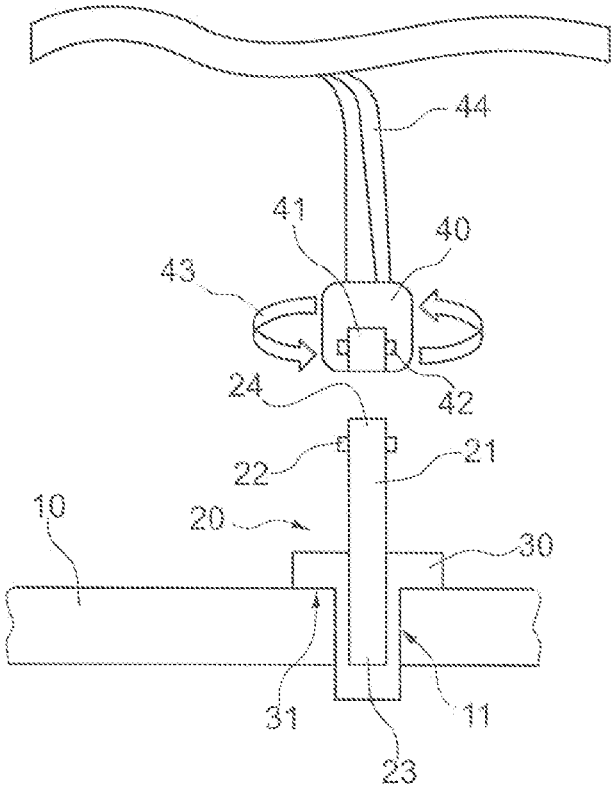
FIG. 1 shows a cross section of a metallic primary-structure element with a ground connection for receiving a connector, which is connected to a cable harness, according to one exemplary embodiment.

FIG. 1 shows a metallic primary-structure element 10 with a ground connection 20 and a sleeve 30. The metallic primary-structure element 10 can be attached in the fuselage of an aircraft at various positions and to various structural elements, for example, to a framework structure, to floor panels or also to frame elements and stringers. In this embodiment the metallic primary-structure element 10 is made from an electrically conductive material and can be attached to the structural elements of the aircraft fuselage by means of a screw connection or a weld connection. It is also possible for the metallic primary-structure element 10 to be firmly integrated in the structural elements, i.e. to be made from one piece with the structural elements of the aircraft, or for the metallic primary-structure element 10 itself to be a structural element of the aircraft, for example a stringer or a frame element.

The metallic primary-structure element 10 can, furthermore, be at least in part plate-shaped or bowl-shaped, wherein the shape of the metallic primary-structure element 10 overall can be complex. The metallic primary-structure element 10 further comprises a recess 11. This recess 11 can be a borehole of any diameter, wherein the borehole is a through-bore or a blind hole that is not completely penetrated by the metallic primary-structure element 10. Furthermore, a ground connection 20 is provided that is, at least in part, made from an electrically conductive material. The ground connection 20 can be a prefabricated and/or a standardized component. For example, the ground connection 20 is a quick-release socket according to ABS 1658, which is designed to accommodate an ABS 1658 quick-release Copalum, or to be connected to the aforesaid. The quick-release socket according to ABS 1658 can be connected in the recess 11 of the metallic primary-structure element 10 by means of a press connection. The ground connection 20 comprises an elongated shape, for example the shape of a pin or bolt. Thus the ground connection 20 can, at least in part, comprise a cylindrical component 21. The cylindrical component 21 can at least in part comprise the shape of a hollow cylinder. For example, the cylindrical component 21 is a tubular component. In this manner it is possible to save weight, which is advantageous, in particular, in the case of aircraft when several such ground connections 20 are provided in an aircraft.

The ground connection 20 further comprises a sleeve 30, wherein the ground connection 20 is connected to the sleeve 30 by way of a press connection, a weld connection or a screw connection. However, the ground connection 20 and the sleeve 30 are preferably integrally manufactured from one component. In particular, such an integrally manufactured component can be a standardized component. The sleeve 30, too, can again be connected to the primary-structure element 10 by way of a press connection, a weld connection or a screw connection. In any case the respective connections are designed in such a manner that electrical current can be conducted from the ground connection 20 to the metallic primary-structure element 10.

The sleeve 30 is also designed so that an electrically conductive connection between the ground connection 20 and the metallic primary-structure element 10 is ensured. This can take place by respective metallic surfaces that are in contact with each other, e.g. by way of a press connection. For example, the sleeve 30 is in contact with the metallic primary-structure element 10 at least by way of a supporting surface 31. The cylindrical component 21 of the ground connection 20 can, as shown in FIG. 1, be plugged or pressed into the sleeve 30, wherein by way of the press connection an electrically conductive connection is established.

The ground connection 20 furthermore comprises at least one, preferably however two, protuberances 22 that project, perpendicularly to the longitudinal axis of the cylindrical component 21 of the ground connection 20, from the generated surface of the cylindrical component 21. The sleeve 30 encloses the cylindrical component 21 of the ground connection 20 so that component 21 is connected to the sleeve 30, for example on a first end 23 of the cylindrical component 21. In this embodiment the sleeve 30 of the ground connection 20 can enclose the cylindrical component 21 of the ground connection 20 in the region of the first end 23 in such a manner that an electrically conductive connection between the ground connection 20 and the metallic primary-structure element 10 takes place merely by way of the sleeve 30. The sleeve 30 can be attached in the recess 11 by means of a press connection, a weld connection or a screw connection.

Furthermore, a connector 40 is provided, which in the region of a second end 24 of the cylindrical component 21 can be plugged onto the ground connection 20 or into the ground connection 20. Plugging-in or plugging-on takes place, for example, by rotating the connector 40 in a direction of rotation 43, as shown in FIG. 1. However, the connector 40 can also be rotated onto the ground connection 20 in a direction of rotation that runs counter to the direction of rotation 43. In this process, rotation of the connector 40 during plugging-on can take place in such a manner that the rotation axis of the connector 40 is parallel and/or congruent to the rotation axis of the cylindrical component 21 of the ground connection 20.

The connector 40 can in part be sheathed by an insulating material, for example a plastic, so that, during plugging the connector 40 onto the ground connection 20, operating personnel are not exposed to the hazard of an electric shock. The connector 40 can comprise a second recess 41, which the ground connection 20 engages when the connector 40 is in its plugged-on or plugged-in state. Holes or elongated holes 42 can be provided on the second recess 41 of the connector 40, which holes or elongated holes 42 the protuberances 22 of the ground connection 20 engage when the connector 40 is in a plugged-on or plugged-in state. In one example the connector 40 is rotated until such time as the protuberances 22 click into the holes or elongated holes 42. In the plugged-on or plugged-in state there is an electrically conductive connection between the connector 40 and the ground connection 20 and thus also between the connector 40 and the metallic primary-structure element 10. The holes or elongated holes 42 can be through-holes or blind holes. The connector 40 can be a standardized and/or a modified component, for example an ASNE 0425, an ABS 1658 quick-release Copalum or a combination of an ASNE 0425 and an ABS 1658 quick-release Copalum. Furthermore, a cable connection, e.g. a cable harness 44, can be connected to the connector 40. This cable harness 44 connects the connector 40 to electrical or electronic devices on board the aircraft. In this manner potential equalization between the electrical or electronic devices and the metallic primary-structure element 10, i.e. with the primary structure of the aircraft, can take place.

Figure 2:
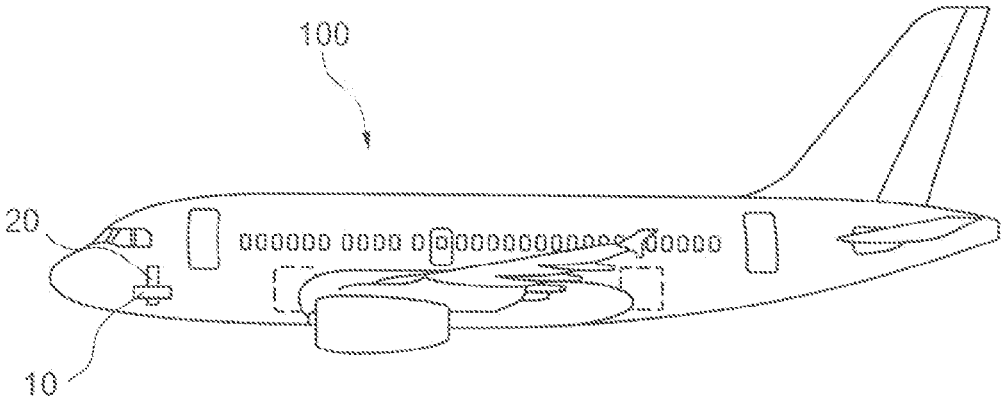
FIG. 2 shows an aircraft with a metallic primary-structure element for receiving a connector according to a second one exemplary embodiment.

FIG. 2 shows an aircraft 100, with a metallic primary-structure element 10 and a ground connection 20. A recess 11 is also provided for receiving a connector 40 (FIG. 1). The metallic primary-structure element 10 is designed to provide potential equalization between the electrical or electronic devices on board the aircraft 100 and the primary structure of the aircraft 100. The primary structure of the aircraft 100 comprises, for example, structural components such as frame elements, stringers, floor panels, framework structures or parts of the aircraft's exterior skin or of the aircraft shell.

Figure 3:
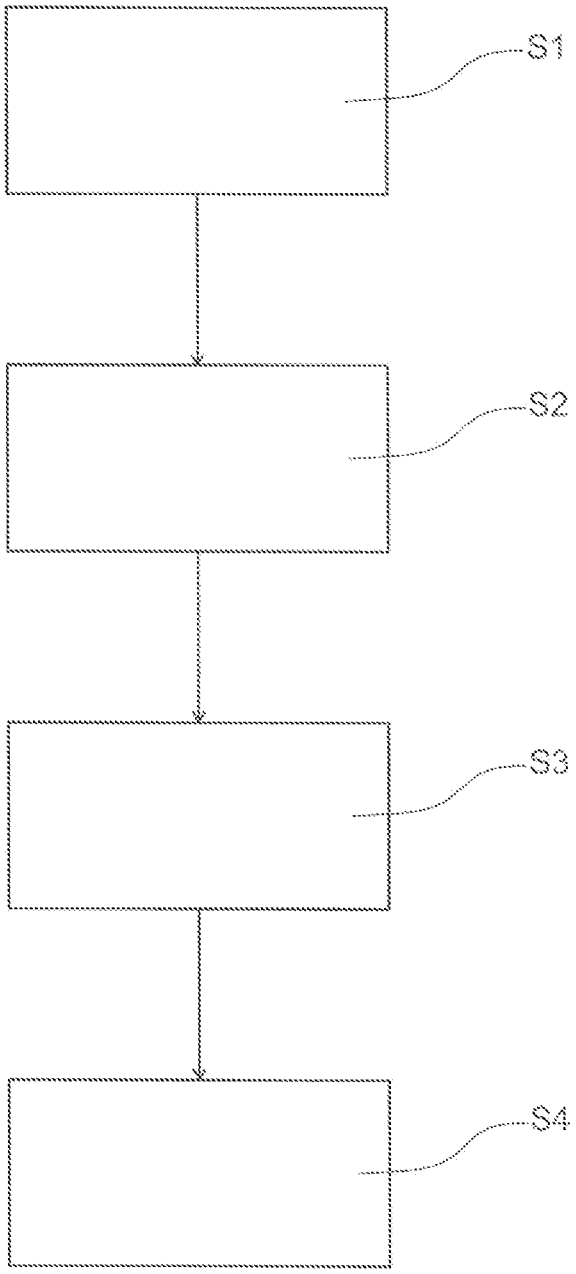
FIG. 3 shows a flow chart for a method for potential equalization in an aircraft according to a further exemplary embodiment.

FIG. 3 is a flow diagram illustrating a method for potential equalization in an aircraft. In one step of the method, a ground connection 20 made of an electrically conductive material is produced. In a further step of the method, a connector 40 is provided that is designed to be plugged onto or plugged into the ground connection 20. In a further step, electrical cable bundles can be provided on the connector 40 by means of which cable bundles the connector 40 can be connected to on-board devices of the aircraft. In a still further step of the method, a metallic primary-structure element 10 for an aircraft is provided (S1).

The aircraft is, for example, an airplane 100. In a further step of the method the ground connection 20 can be inserted into the metallic primary-structure element 10. Associated with this, the ground connection 20 can be sealed for transport to the location of assembly so that in this way, for example, the ground connection 20 is protected against external influences such as humidity and mechanical loads, before this ground connection 20 together with the metallic primary-structure element 10 is affixed in the primary structure of the aircraft 100. However, it is also possible that the ground connection 20 is affixed to the metallic primary-structure element 10 only after the metallic primary-structure element 10 has been affixed in the aircraft 100.

In a still further step, of the method, the metallic primary-structure element 10 is affixed in the aircraft. In a further step the method provides for the attachment of the ground connection 20 to a recess 11 of the metallic primary-structure element 10 (S2). The method can, furthermore, provide for the pressing of the ground connection 20 into the recess 11 of the metallic primary-structure element 10. The metallic primary-structure element 10 can, however, also be firmly integrated in the primary structure of the aircraft 100. In a further step of the method an electrically conductive connection between the metallic primary-structure element 10 and the ground connection 20 is established (S3). In a further step, the method provides for the ground connection 20 to receive the connector 40 (S4). This step is also referred to as the system installation. In this manner an electrically conductive connection for potential equalization between electrical or electronic devices on board the aircraft and the aircraft itself can be produced.

It should be pointed out that "comprising" does not exclude other elements or steps, and "a" or "an" does not exclude a plural number. Furthermore, it should be pointed out that characteristics or steps that have been described with reference to one of the above exemplary embodiments can also be used in combination with other characteristics or steps of other exemplary embodiments described above. Reference characters in the claims are not to be interpreted as limitations.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the embodiment in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the embodiment as set forth in the appended claims and their legal equivalents.

What is claimed is:

1. An electrically conductive metallic primary-structure element for an aircraft, comprising:

a recess; and a ground connection that is attached to the metallic primary-structure element in the recess, the ground connection couples in an electrically conductive manner to the metallic primary-structure element, and configured to receive a connector.

2. The metallic primary-structure element of claim 1, wherein the recess is a borehole.

3. The metallic primary-structure element of claim 1, wherein the ground connection comprises a cylindrical component.

4. The metallic primary-structure element of claim 3, wherein the ground connection comprises at least one protuberance that projects, perpendicularly to a longitudinal axis of the cylindrical component of the ground connection, from an outer surface of the cylindrical component.

5. The metallic primary-structure element of claim 1, wherein the ground connection comprises a sleeve that is electro-conductively coupled to the metallic primary-structure element.

6. The metallic primary-structure element of claim 5, wherein the sleeve is rotationally symmetrical and comprises at least one supporting surface that is connected to the metallic primary-structure element.

7. The metallic primary-structure element of claim 5, wherein the connection between the rotationally symmetrical sleeve and the metallic primary-structure element is selected from the group comprising a screw connection, a weld connection or a press connection.

8. An aircraft primary structure comprising a plurality of metallic primary-structure elements configured in accordance with claim 1.

9. An electrically conductive metallic primary-structure element for an aircraft, comprising:

a recess; and a ground connection that is coupled to the metallic primary structure in the recess, the ground connection, electrically coupled to the metallic primary-structure element and configured to receive a connector, wherein the ground connection comprises a sleeve that is electro-conductively coupled to the primary-structure element, and wherein the sleeve is rotationally symmetrical and comprises at least one supporting surface that is connected to the metallic primary-structure element.

10. A metallic primary-structure element for an aircraft, comprising:

a recess; and a ground connection that is attached to the metallic primary-structure element in the recess, the ground connection couples in an electrically conductive manner to the metallic primary-structure element, and configured to receive a connector;

wherein the ground connection comprises a sleeve that is electro-conductively coupled to the metallic primary-structure element; and wherein the connection between the rotationally symmetrical sleeve and the cylindrical component of the ground connection is selected from the group comprising a screw connection, a weld connection, or a press connection.

* * * * *